US005787507A

United States Patent [19]

Sullivan

[11] Patent Number: 5,787,507

[45] Date of Patent: Aug. 4, 1998

[54] HEADGEAR STABILISING AND VENTILATING APPARATUS

[76] Inventor: Lorraine June Sullivan, 34a, Fifth Avenue, Bassendean, Western Australia 6054, Australia

[21] Appl. No.: 828,382

[22] Filed: Mar. 28, 1997

Related U.S. Application Data

[63] Continuation of Ser. No. 428,151, filed as PCT/AU93/00550 Oct. 27, 1993 published as WO94/09658, May 11, 1994, abandoned.

[30] Foreign Application Priority Data

Oct. 30, 1992 [AU] Australia ..... PL5562

[51] Int. Cl.[6] ..... A42C 5/04

[52] U.S. Cl. ..... 2/182.1; 2/7; 2/182.2; 2/182.6; 2/209.13

[58] Field of Search ..... 2/7, 182.1, 182.2, 2/182.3, 182.6, 209.13, DIG. 1, 181.4

[56] References Cited

U.S. PATENT DOCUMENTS

| | | | |
|---|---|---|---|
| 2,997,792 | 8/1961 | Straus, II | 2/182.1 |
| 3,505,683 | 4/1970 | Wright | 2/182.6 |
| 4,951,320 | 8/1990 | Yoon | 2/182.6 |
| 5,101,516 | 4/1992 | Scarnato . | |
| 5,572,746 | 11/1996 | Linico | 2/182.1 |

FOREIGN PATENT DOCUMENTS

| | | |
|---|---|---|
| 2168926 | 1/1972 | France . |
| 519869 | 9/1971 | Switzerland . |
| 2161967 | 8/1984 | United Kingdom . |

*Primary Examiner*—Diana Biefeld
*Attorney, Agent, or Firm*—Reising, Ethington, Learman & McCulloch

[57] ABSTRACT

A headgear stabilizing and venting apparatus comprises a flexible material having attachment means provided on a first side thereof and a plurality of resilient flexible spacing means provided in a second side thereof. The length of the flexible material enables the apparatus to be positioned within a crown portion of an article of headgear enabling the spacing means to engage the user's head when the headgear is worn. The spacing means serves to space the headgear with respect to the user's head to permit air to flow therebetween and further to flex against the user's head in order to stabilize the headgear in position.

15 Claims, 7 Drawing Sheets

HEADGEAR STABILISING AND VENTILATING APPARATUS

This application is a continuation of application Ser. No. 08/428,151 filed on Jun. 1, 1995 (now abandoned) which is a 371 of International Application PCT/AU93/00550 filed on Oct. 27, 1993, published as WO94/09658, May 11, 1994 and which designated the U.S.

DESCRIPTION

The present invention relates to a headgear stabilising and ventilating apparatus.

More particularly, the apparatus of the present invention is intended to be provided within the crown of the headgear and to space the same away from a wearer's head.

FIELD OF THE INVENTION

Typically, if an article of headgear, for example a hat is worn for an extended period of time it can result in the wearer perspiring heavily due to lack of ventilation and consequent heat build up. A hat worn for an extended period may also flatten a user's hair. Both the flattening of a wearer's hair and the heavey perspiration are undesirable. A hat may also dislodge from a wearer's head if in a wind or if the wearer is undertaking certain forms of activity, for example horse rifing. Hats can also leave uncomfortable and unsightly ridges and rashes on a wearer's forehead. Further, in an effort to prevent a hat from being dislodged a wearer will often choose a tight or close-fitting hat that consequently may cause or exacerbate some of the abovementioned problems together with the likelihood of headaches in the wearer.

SUMMARY OF THE INVENTION

The present invention provides a headgear stabilising and ventilating apparatus that has as one object thereof to overcome the abovementioned problems associated with the prior art.

In accordance with one aspect of the present invention there is provided a headgear stabilising and ventilating apparatus characterised in that a length of flexible material is provided having a first side and a second side, the first side having provided thereon an attachment means, the second side having a plurality of resilient or flexible spacing means provided thereon, the length of flexible material able to be positioned within a crown portion of an article of headgear so as the spacing means space the headgear away from, and stabilise the headgear with respect to a wearer's head, each specing means being independent and distinct upon the second side so as to allow air flow therebetween.

Preferably, the spacing means are formed from a flexible material and have a rounded tip provided thereon.

BRIEF DESCRIPTION OF THE DRAWINGS

The present invention will now be described, by way of example only, with reference to the accompanying drawings, in which.

DESCRIPTION OF THE INVENTION

Figure 1:
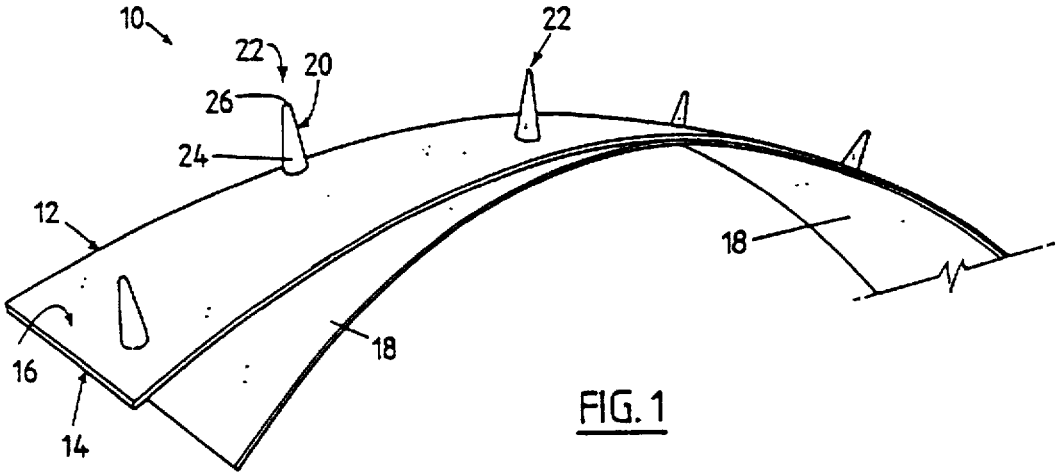
FIG. 1 is an upper perspective view of a portion of a headgear stabilising and ventilating apparatus in accordance with the present invention.

In FIG. 1 there is sown a headgear stabilising and ventilating apparatus 10 comprising a length of flexible material 12 having a first side 14 and a second side 16. The first side 14 of the flexible material 12 is releasably adhered to a strip 18. The strip 18 prevents the first side 14 or a part thereof from adhering to anything prior to fitting the apparatus 10 into any form of headgear.

The second side 16 of the flexible material 12 has a plurality of spacing means, for example fingers 20 provided thereon. The fingers 20 are arranged in at least two rows 22 in a staggered and alternating manner and stand upright from the side 16. Each finger 20 has a broad base portion 24 and a substantially rounded tip portion 26. It is the tip portion 26 of the fingers 20 that will contact a wearer's head when worn. The fingers 20 are generally of a conical shape.

Figure 2:
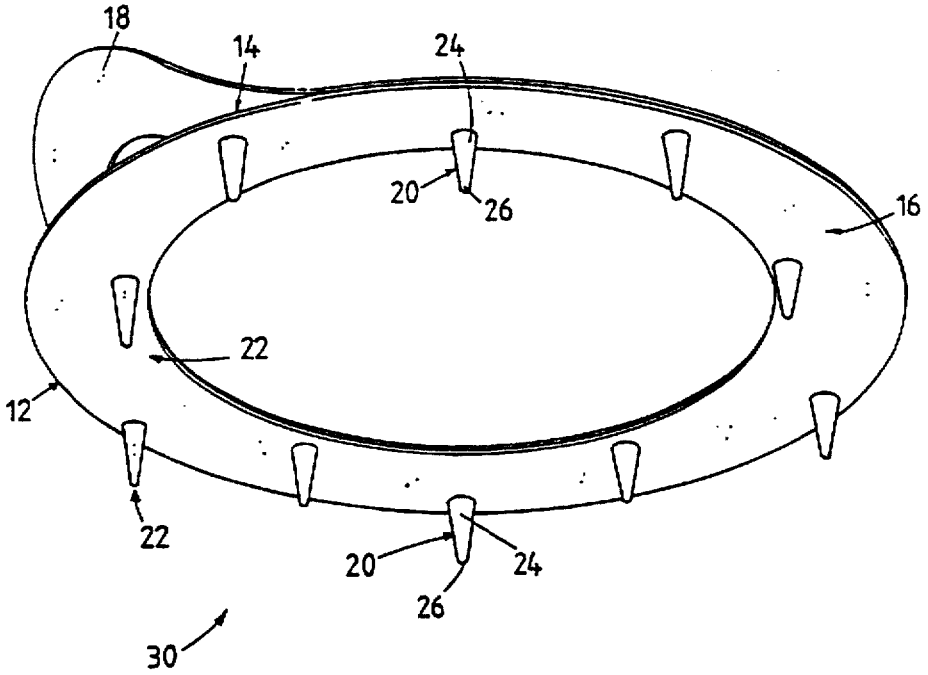
FIG. 2 is a lower perspective view of a headgear stabilising and ventilating apparatus in accordance with the present invention shown formed in an annular shape.

In FIG. 2 there is shown a headgear stabilising and ventilating apparatus 30. The apparatus 30 is formed in an annular shape but is substantially similar to the apparatus 10 of FIG. 1 and like numerals denote like parts.

Figure 3:
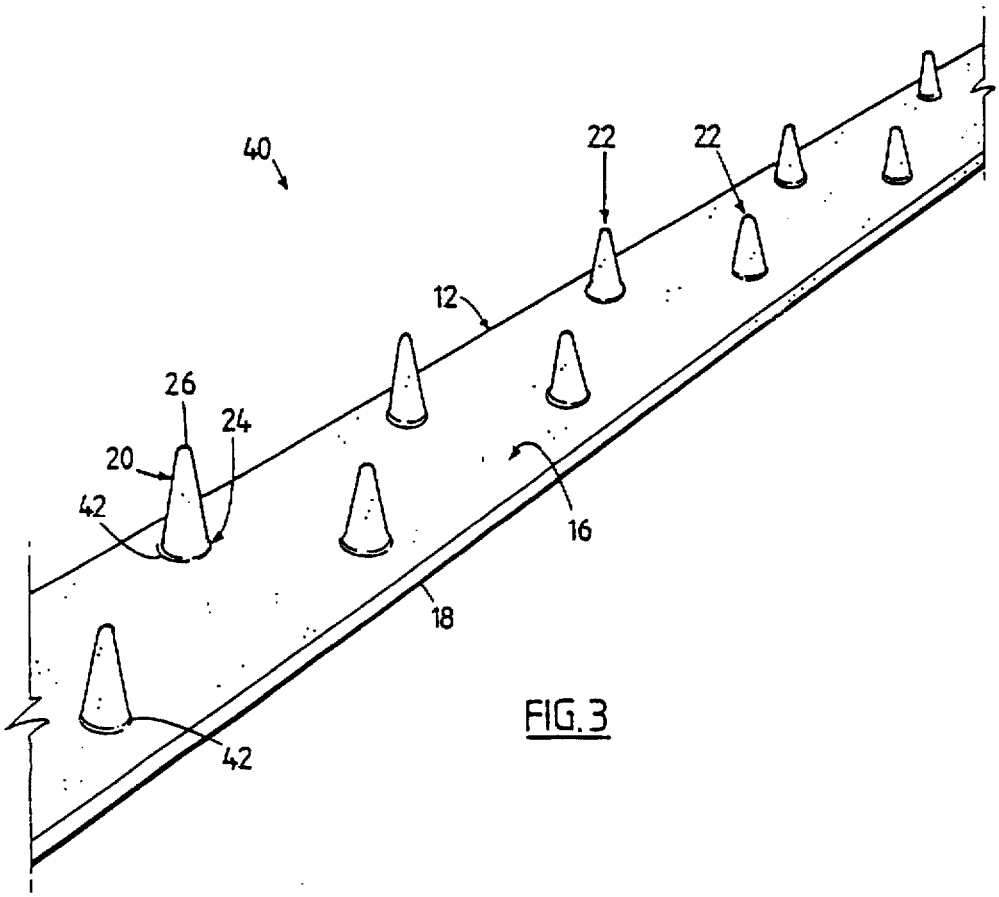
FIG. 3 is a further upper perspective view of the headgear stabilising and ventilating apparatus of FIG. 1.

In FIG. 3 there is shown a headgear stabilising and ventilating apparatus 40. The apparatus 40 is substantially similar to the apparatus 10 of FIG. 1 and like numerals denote like parts. The broad base portion 24 of each finger 20 has provided thereat a sloping flange 42. The flange 42 provides a smooth transition between the base portion 24 and the first side 14 of the flexible material 12.

Figure 4:
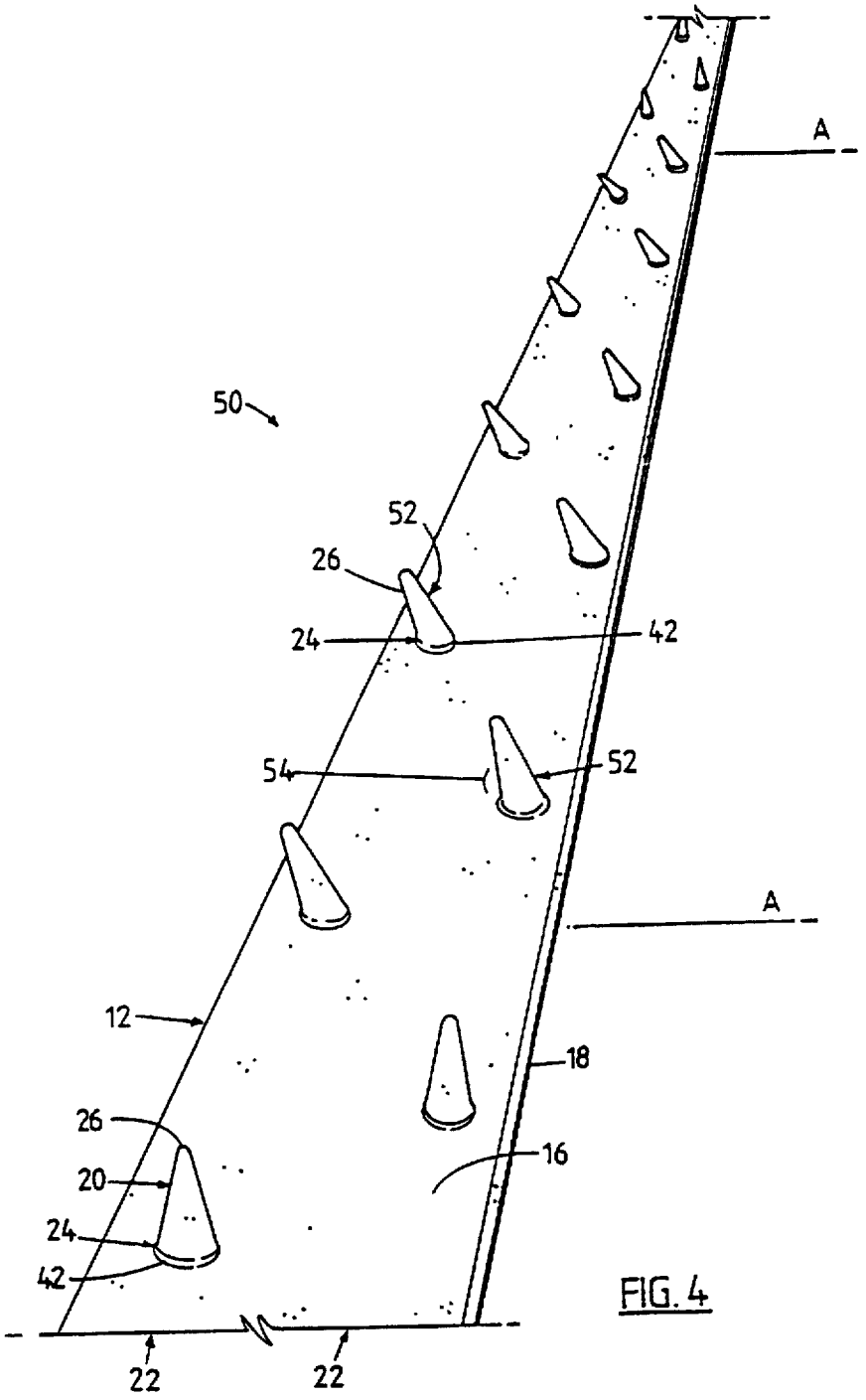
FIG. 4 is an upper perspective view of a portion of a headgear stabilising and ventilating apparatus inaccordance with a second embodiment of the present invention.

In FIG. 4 there is shown a headgear stabilising and ventilating apparatus 50. the apparatus 50 is substantially similar to the apparatus 40 of FIG. 3 and like numerals denote like parts. The first side 14 of the flexible material 12 has provided thereon, in addition to the fingers 20, a plurality of fingers 52. A section A—A of the length of flexible material 12 is provided with fingers 52 arranged in rows contiguous with the rows 22 of fingers 20.

The fingers 52 are substantially similar to the fingers 20 of FIG. 3 and like numerals denote like parts. However, the fingers 52 project from the second side 16 at an acute angle 52 thereto.

Figure 5:
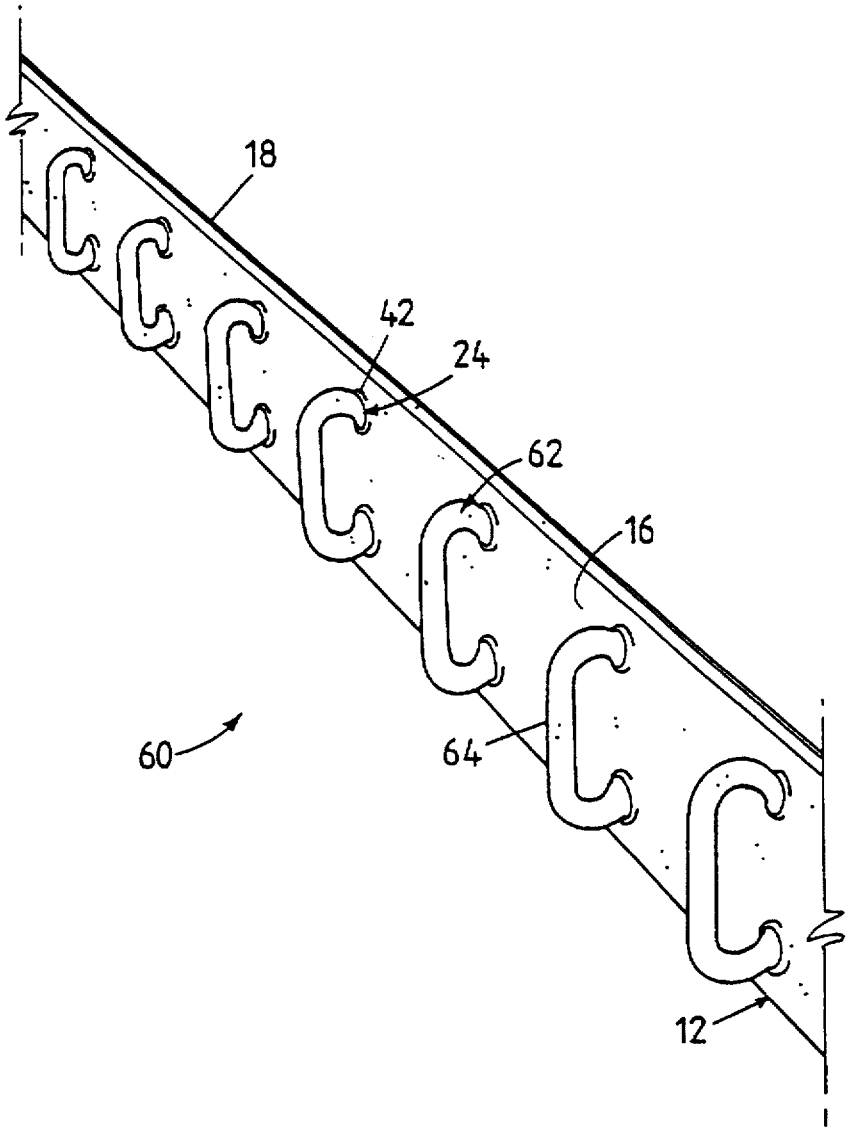
FIG. 5 is an upper perspective view of a portion of a headgear stabilising and ventilating apparatus in accordance with a third embodiment of the present invention.

In FIG. 5 there is shown a headgear stabilising and ventilating apparatus 60. The apparatus 60 is substantially similar to the apparatus 40 of FIG. 3 and like numerals denote like parts. The spacing means take the form of loops 62 upstanding from the second side 16 of the length of flexible material 12. The loops 62 are flexibly resilient and have an upper portion 64 spaced farthest from the second side 16 and provided to contact the head of a wearer when worn.

The loops 62 each have two base portions 24 each having the flange 42 provided thereat. the loops 62 run substantially transverse to the length of flexible material 12.

Figure 6:
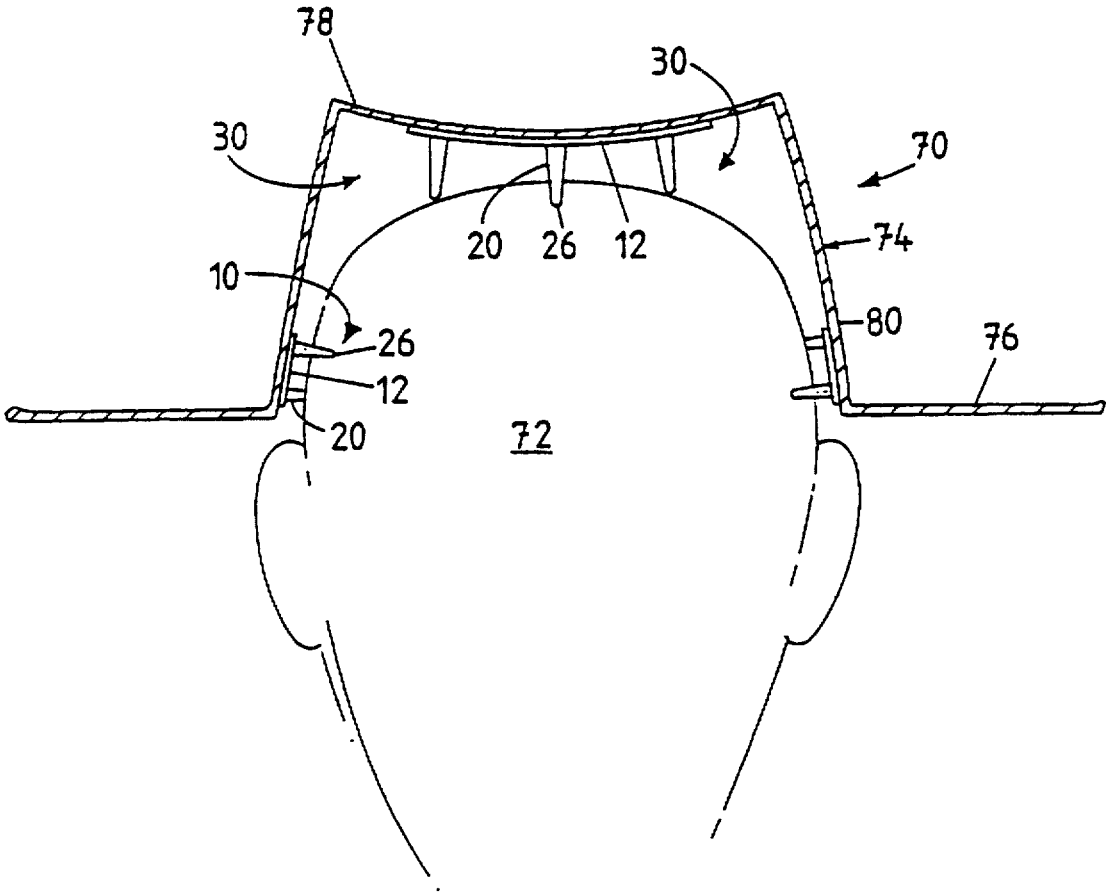
FIG. 6 is a cross-sectional frontal elevation of a hat being worn by a wearer, the hat having the apparatus of FIGS. 1 and 2 fitted therein.

In FIG. 6 there is shown the apparatus' 10 and 30 in position in a hat 70 on a wearer's head 72.

The hat comprises a crown 74 and a brim 76. The crown 74 has an uppermost portion78 and a side portion 80.

The apparatus 10, after removal of the strip 18 from the first side thereof, is adhered to an inner surface of the side portion 80 of the crown 74 adjacent the brim 76, as can be seen in FIG. 6.

The apparatus 30, after removal of the strip 18 from the first side 14 thereof is adhered to an inner surface of the uppermost portion 78 of the crown 74, as can be seen in FIG. 6.

Figure 7:
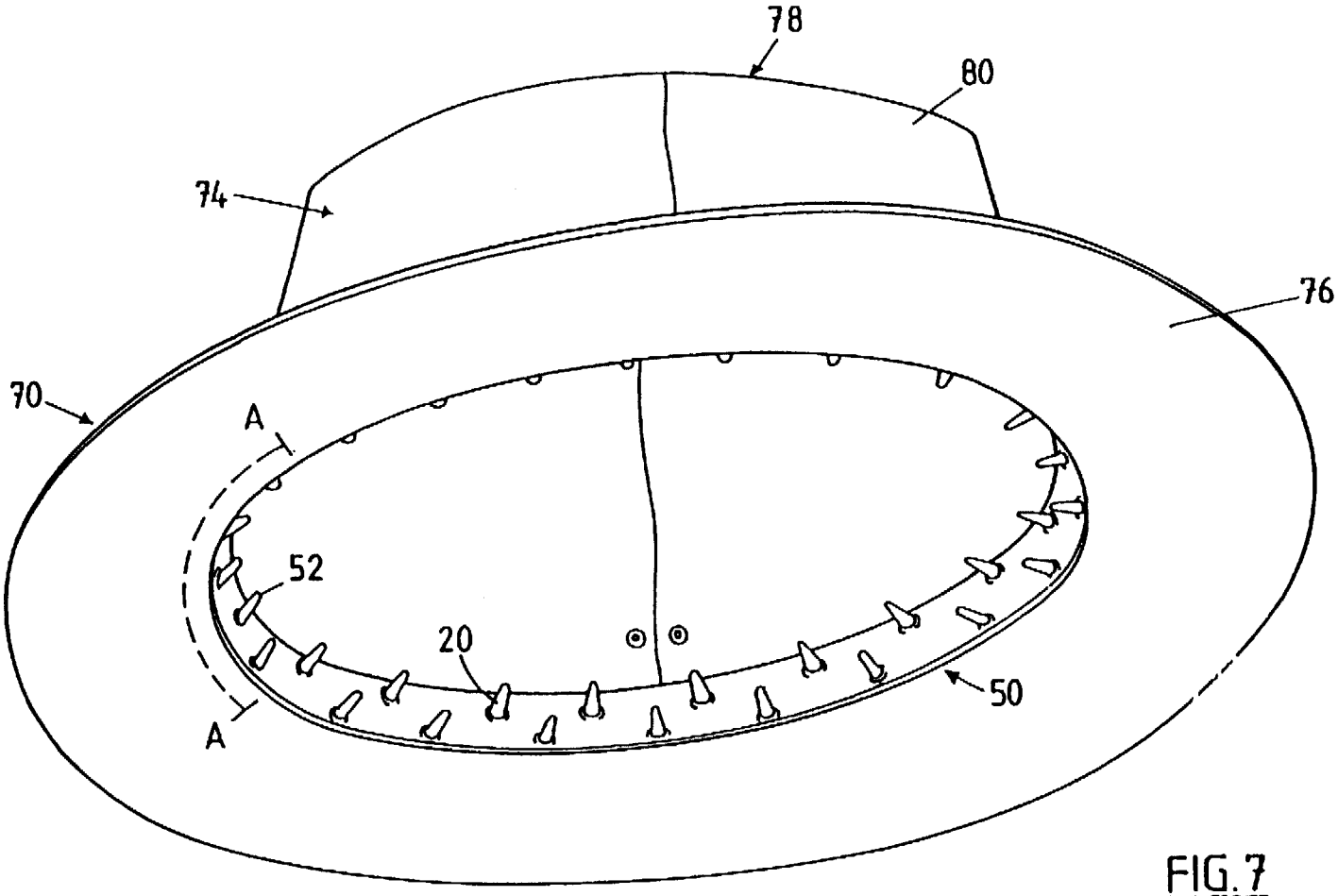
FIG. 7 is a lower perspective view of a hat having fitted therein the apparatus of FIG. 4.

In FIG. 7 there is shown the apparatus 50 in position in the hat 70 shown in FIG. 6, like numerals denote like parts. the apparatus 50, after removal of the strip 18 from the first side 14 thereof is adhered to an inner surface of the side portion 80 of the crown 74 adjacent the brim 76.

Figure 8:
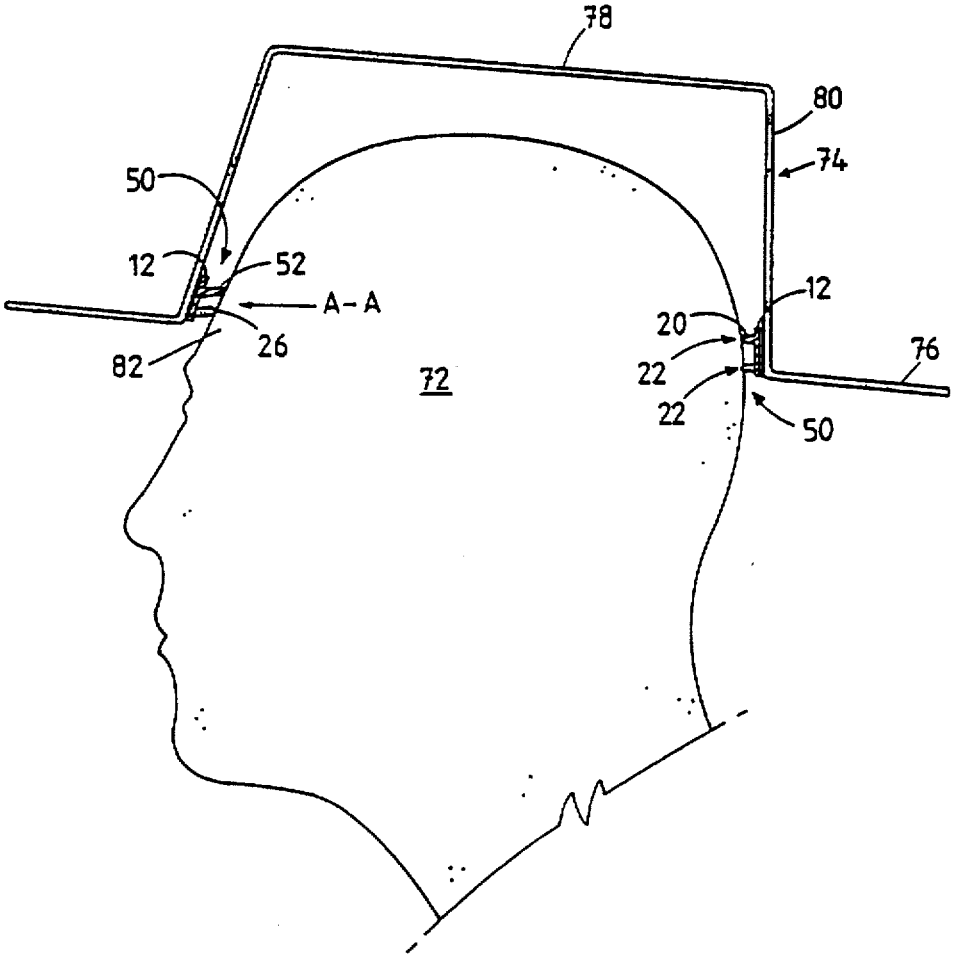
FIG. 8 is a cross-sectional side elevation of a hat being worn by a wearer, the hat having fitted therein the apparatus of FIG. 4.

In FIG. 8 there is shown the apparatus 50 in position in the hat 70, the hat 70 being in position on the wearer's head 72. The section A—A of the length of flexible material 12 is positioned adjacent the wearer's forehead 82, as can be seen in FIG. 8.

In use, the strip 18 is peeled away from the first side 14 of the length of flexible material 12. A user or wearer can then adhere or otherwise position the headgear stabilising and ventilating apparatus 10, 30, 40, 50 or 60 within the crown 74 of the hat 70 as described hereinabove. The fingers 20 and/or 52 of each headgear stabilising and ventilating apparatus space the hat 70 away from a wearer's head 72, as can be seen in FIGS. 6 and 8. This spacing allows air to flow into and out of the crown 74 of the hat 70. the ventilation achieved in this manner reduces the perspiration from the head 72 of the wearer.

When the hat 70 and its headgear stabilising and ventilating apparatus 10, 30, 40, 50 and/or 60 is placed on a wearer's head 72 the hat 70 is pulled down to a point where the fingers 20 and/or 52 are at least slightly flexed. This action ensures that the hat 70 is stabilised on the wearer's head 72 and prevents the hat 70 from being easily dislodged by something brushing thereagainst or under the influence of wind movement.

In the headgear stabilising and ventilating apparatus 50 the provision of fingers 52 within the portion A—A allows slightly less pressure to be applied to the forehead 82 of the wearer as this is often a more sensitive area of the head 72. In addition, at the forehead 82 there is generally little hair for the fingers 52 to penetrate.

In the avovementioned regard, the fingers 20 and/or 52 serve also to reduce interference with the wearer's hair. The wearer's hair is not flattened or crushed as the fingers 20 and/or 52 are able to penetrate through the hair to touch the wearer's head 72. Under normal circumstances without any form of headgear stabilising and ventilating apparatus as described herein the side portion 80 of the crown 74 of the hat 70 would come into direct contact with the hair of a wearer and flatten it to the wearer's head 72. Further, at the forehead 82 of the wearer's head 72 the side portion 80 would directly bear thereagainst. Such an action can produce rashes on the forehead 82 or leave deep ridges thereon.

The degree of flexing achieved in the fingers 20 and/or 52 is largely a matter of personal preference although a greater degree of flexing and therefor stability may be required under cetain circumstances, such as high wind conditions.

The headgear stabilising and ventilating apparatus 60 of the present invention is used in a substantially similar manner to the spparatus' 10, 30, 40 and 70. The loops 62 space the side portion 80 of the crown 74 of the hat 70 away from the wearer's head 72. In a similar manner as described hereinabove for fingers 20 and/or 52 the loops 62 are able to flex once the upper portion 64 of the loop 62 is resting against the wearer's head 72. The loops 62 are also in a similar manner able to project through the hair on a wearer's head 72. Further, the loops 62 and the upper portion 64 thereof may in fact be more comfortable for a wearer.

The fingers 20 and 52 and the loops 62 are preferably formed from a flexible material 12. Such suitable materials may be rubber, for example Santoprene (Trade Mark), silicon and other similar materials.

The strip 18 is prefereably formed from a paper material which may be easily separated from the adhesive on the flexible material 12 at the required time.

It is envisaged that the length of flexible material 12 may be supplied in varying lengths and trimmed to the correct length to fit the particular wearer's hat 70. In addition, the headgear stabilising and ventilating apparatus 30 may be supplied in varying annular sizes to suit different styles and sizes of hats 70.

The rows 22 in which the fingers 20 and/or 52 are provided serve to maximize the stability and airflow whilst having to provide the least number of fingers 20 and/or 52. The fact that the rows 22 are spaced apart transversely across the length of material 12 adds to the stability of the headgear stabilising and ventilating apparatus' 10, 30, 40 and 50. The transversely spaced nature of the rows 22 prevents any rocking or twisting motion of the hat 70 having the headgear stabilising and ventilating apparatus' 10, 30, 40 and/or 50 attached thereto. A similar action is exhibited by the headgear stabilising and ventilating apparatus 60 in the provision of the transversely extending loops 62 across the length of the flexible material 12.

It is envisaged that the headgear stabilising and ventilating apparatus 30 may be combined with any of the headgear stabilising and ventilating apparatus' 10, 40, 50 and/or 60.

It is further envisaged that the method of attachment of the headgear stabilising and ventilating apparatus 10, 30, 40, 50 or 60 may be by way of adhesive or velcro strips.

It is still further envisaged that the fingers 20 and/or 52 may be provided such that one row 22 comprises fingers 20 and/or 52 that are smaller in height than the fingers 20 and/or 52 of the other row 22. For example, such a situation is depected in FIG. 3. Such an arrangement allows the headgear stabilising and ventilating apparatus 40 to adapt to the wearer's head 72 more effectively wherein the fingers 20 follow the contours of the wearer's head 72 to some extent. This increases the level of comfort in the wearer and adds to the stability of the hat 70 on the wearer's head 72.

Modifications and variations such as would be apparent to a skilled addressee are deemed within the scope of the present invention.

I claim:

1. A headgear stabilizing and ventilation apparatus comprising a length of flexible material having a first side and a second side, said first side having provided thereon an attachment means, said second side having a plurality of resilient flexible spacing means provided thereon, whereby said length of flexible material may be circumferentially positioned within a lower section of a crown portion of an article of headgear so that each of said plurality of spacing means opposes another of said plurality of spacing means, and whereby said plurality of spacing means space said headgear away from and stabilize said headgear with respect to a wearer's head, wherein each of said spacing means is independent and distinct upon said second side so as to allow air flow between said plurality of spacing means and whereby the flexing of said plurality of spacing means against a wearer's head stabilizes said headgear with respect thereto.

2. Apparatus as claimed in claim 1 wherein each spacing means has a tip portion adapted to contact a wearer's head and to flex when pressed thereagainst.

3. Apparatus as claimed in claim 1 wherein said plurality of spacing means are provided in at least two rows spaced transversely along said length of flexible material.

4. Apparatus as claimed in claim 3 wherein said individual spacing means of each of said two or more rows are arranged in a staggered manner along said length of flexible material.

5. Apparatus as claimed in claim 1 wherein a large portion of said plurality of spacing means stand substantially upright from said second side of said length of flexible material.

6. Apparatus as claimed in claim 1 wherein a portion of said length of flexible material is provided with a plurality of said spacing means that stand at an acute angle to said second side of said length of flexible material.

7. Apparatus as claimed in claim 1 wherein said spacing means are substantially conical in shape with each having a broad base and a narrow and substantially rounded tip portion.

8. Apparatus as claimed in claim 1 wherein a part of all of said plurality of spacing means takes the form of loops of flexibly resilient material located in a substantially transverse orientation to said length of flexible material.

9. Apparatus as claimed in claim 1 wherein said spacing means are provided in at least two rows spaced transversely along said length of flexible material and siad spacing means comprising one or more of said rows are of a smaller length than said spacing means comprising the remainder of said rows.

10. A combination article of headgear and headgear stabilizing and ventilating apparatus wherein the apparatus comprises a length of flexible material having a first side and second side, said first side being attached within a crown portion of said article of headgear, said second side having a plurality of resilient or flexible opposing spacing means provided thereon to space said headgear away from, and stabilize said headgear with respect to a wearer's head interposed therebetween, wherein each of said spacing means is independent and distinct upon said second side so as to allow air flow therebetween and whereby the flexing of said spacing means against a wearer's head stabilizes said headgear with respect thereto.

11. The combination as defined in claim 10 further comprising:

said first side being attached to an inner surface of a side portion of sid crown such that when said headgear is on a wearer's head, the spacing means engages at least one side of a wearer's head.

12. The combination as defined in claim 11 further comprising:

said spacing means being positioned such that when said headgear is on a wearer's head, said spacing means engages a forehead of a wearer.

13. The combination as defined in claim 10 further comprising:

said first side being attached to an inner surface of an uppermost portion of said crown such that when said headgear is on a wearer's head, said spacing means engages a top of a wearer's head.

14. The combination as defined in claim 13 further comprising:

a portion of said length of flexible material being provided with a plurality of said spacing means that stand at an acute angle to said second side of said length of flexible material.

15. The combination as defined in claim 13 further comprising:

said spacing means being provided in at least two rows spaced transversely along said length of flexible material and said spacing means comprising one or more of said rows being of a smaller length that said spacing means comprising the remainder of said rows.

* * * * *

UNITED STATES PATENT AND TRADEMARK OFFICE

CERTIFICATE OF CORRECTION

PATENT NO. : 5,787,507

DATED : August 4, 1998

INVENTOR(S) : Lorraine June Sullivan

It is certified that error appears in the above-identified patent and that said Letters Patent is hereby corrected as shown below:

Column 1, line 24, after "the" delete "heavey" and insert therefor --heavy--.

Column 1, line 27, after "horse" delete "rifing" and insert therefor --riding--.

Column 2, line 17, after "there is" delete "sown" and insert therefor --shown--.

Column 3, line 3, after "hat" insert therefor --70--.

Column 5, line 27, after "part" delete "of" and insert

UNITED STATES PATENT AND TRADEMARK OFFICE

CERTIFICATE OF CORRECTION

PATENT NO. : 5,787,507

DATED : August 4, 1998

INVENTOR(S) : Lorraine June Sullivan

It is certified that error appears in the above-identified patent and that said Letters Patent is hereby corrected as shown below:

therefor --or--.

Column 5, line 33, after "material and" delete "siad"

and insert therein --said--.

Column 6, line 12, after "portion of" delete "sid"

and insert therefor --said--.

Signed and Sealed this

Eighth Day of June, 1999

*Attest:*

Q. TODD DICKINSON

*Attesting Officer*

*Acting Commissioner of Patents and Trademarks*